US010339729B2

(12) United States Patent
Everwyn et al.

(10) Patent No.: US 10,339,729 B2
(45) Date of Patent: Jul. 2, 2019

(54) METHOD FOR DETECTING AN INCREASE IN THE RATING OF A LOW-PRESSURE TURBINE OF AN AIRCRAFT REACTOR DURING A CRUISING FLIGHT PHASE, AND ASSOCIATED DEVICE AND METHOD FOR REGULATING THE COOLING AIR FLOW RATE OF A LOW-PRESSURE TURBINE

(71) Applicant: SAFRAN AIRCRAFT ENGINES, Paris (FR)

(72) Inventors: Alexandre Patrick Jacques Roger Everwyn, Viry Chatillon (FR); Arnaud Rodhain, Maisons-Alfort (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 253 days.

(21) Appl. No.: 15/232,975

(22) Filed: Aug. 10, 2016

(65) Prior Publication Data

US 2017/0046886 A1 Feb. 16, 2017

(30) Foreign Application Priority Data

Aug. 11, 2015 (FR) ..... 15 57671

(51) Int. Cl.
*F01D 11/24* (2006.01)
*F01D 17/14* (2006.01)
(Continued)

(52) U.S. Cl.
CPC ..... *G07C 5/0816* (2013.01); *F01D 11/24* (2013.01); *F01D 17/145* (2013.01);
(Continued)

(58) Field of Classification Search
CPC .. F01D 11/24; F01D 17/145; F05D 2220/323; F05D 2240/24; F05D 2260/80;
(Continued)

(56) References Cited

U.S. PATENT DOCUMENTS

2010/0303612 A1 12/2010 Bhatnagar et al.
2014/0058644 A1 * 2/2014 Adibhatla ..... B64D 31/06 701/100

FOREIGN PATENT DOCUMENTS

FR 2 508 670 12/1982
FR 2 997 443 A1 5/2014

OTHER PUBLICATIONS

French Preliminary Search Report dated Jun. 3, 2016 in French Application 15 57671, filed on Aug. 11, 2015 ( with English Translation of Categories of Cited Documents).

* cited by examiner

*Primary Examiner* — Charles J Han
(74) *Attorney, Agent, or Firm* — Oblon, McClelland, Maier & Neustadt, L.L.P.

(57) ABSTRACT

A method for detecting an increase in the rotor speed of a low-pressure turbine of a detection of an increase in the rating of a low-pressure turbine of a reactor of an aircraft reactor during a cruising flight phase, is provided. The method includes: measuring the rotor speed of the low-pressure turbine via a sensor; determining a rotor speed gradient of the low-pressure turbine from the measured rotor speed; comparing the determined rotor speed gradient to a reference rotor speed gradient; determining a positive or negative indication that the aircraft is under cruising phase conditions from flight parameters of the aircraft; and activating an alarm if the determined rotor speed gradient is higher than the reference rotor speed gradient and if the received indication is positive.

4 Claims, 2 Drawing Sheets

(51) Int. Cl.
*G08B 21/18* (2006.01)
*G07C 5/08* (2006.01)

(52) U.S. Cl.
CPC ..... *G08B 21/182* (2013.01); *F05D 2220/323* (2013.01); *F05D 2240/24* (2013.01); *F05D 2260/80* (2013.01); *F05D 2260/821* (2013.01)

(58) Field of Classification Search
CPC ..... F05D 2260/821; G07C 5/0816; G08B 21/182
See application file for complete search history.

METHOD FOR DETECTING AN INCREASE IN THE RATING OF A LOW-PRESSURE TURBINE OF AN AIRCRAFT REACTOR DURING A CRUISING FLIGHT PHASE, AND ASSOCIATED DEVICE AND METHOD FOR REGULATING THE COOLING AIR FLOW RATE OF A LOW-PRESSURE TURBINE

BACKGROUND OF THE INVENTION

The invention relates to controlling a protective air flow rate of a low-pressure turbine in an aircraft reactor, and more particularly detecting an increase in the rotor speed of the low-pressure turbine.

Depending on the flight phase of an aircraft, the evolution of the speed of a turbojet engine causes a deformation in the vanes of the low-pressure turbine as well as the casing of that same turbine. These deformations are due on the one hand to the increase or decrease in the temperature of the low-pressure turbine, and on the other hand to the effect of the centrifugal force exerted on the vanes of the rotor of the turbine.

This phenomenon results in modifying, during a flight of the aircraft, the distance between the apex of the vanes and the surface of the casing. When the play between the apex of the vanes of the turbine and the casing increases, part of the air suctioned in the casing no longer passes into the turbine. The performance of the engine is then decreased, and the consumption of the turbojet engine increases to obtain the same speed.

It is therefore necessary to cool the casing of the low-pressure turbine more or less in order to continuously minimize the distance separating the apex of the vanes and the casing of the low-pressure turbine.

In order to cool low-pressure turbine, cold air is extracted from the secondary flow taken at the fan and/or the compressor of the turbine engine, in order to be conveyed via channels to the outer surface of the low-pressure turbine.

Along these channels, an air valve with a regulated position, referred to as LPTACC (Low Pressure Turbine Active Clearance Control), makes it possible to regulate the air flow rate to be sent onto the turbine according to the setpoint from the electronic engine control (EEC) unit.

Given that the deformations of the casing are only due to the thermal expansion, while the vanes undergo deformations due both to the thermal expansion and the centrifugal force, the elongation of the vanes is generally greater than the radial deformation of the casing.

The vanes deforming more than the casing at the same rotation speed and the same temperature, the apex of the vanes risks wearing the abradable coating of the casing and thus causing permanent incurable play without repair between the apex of the vanes and the casing in which the vanes move.

During a cruising phase of a flight, the thrust from an engine may suddenly increase for several reasons, for example a gust of wind or a change in altitude ordered by air traffic control. The engine speed then increases from a cruising phase level to a step-climb phase level.

The sudden increase in the rotor speed of the turbine causes sudden deformations of the vanes due to the thermal expansion and the centrifugal force.

However, the aircraft being in a cruising phase, the cooling air flow rate is optimized to reduce deformations of the casing. As a result, the sudden increase in the rotor speed of the turbine during the cruising phase causes a quicker and more substantial deformation of the vanes, due to the deformations generated by the centrifugal force, than the deformation of the casing.

This difference in deformation amplitude then causes a significant risk of wear of the abradable coating.

The known systems for regulating the cooling air flow rate of the low-pressure turbines of aircraft have no logic for detecting the different flight phases. Consequently, there is a significant risk of wear of the abradable coating, in particular upon each sudden increase of the rotor speed of the low-pressure turbine during the cruising phase.

SUBJECT MATTER AND BRIEF DESCRIPTION OF THE INVENTION

The invention seeks to avoid such drawbacks by anticipating, during a cruising phase, the sudden elongation of the vanes of the low-pressure turbine, which risks causing wear of the abradable coating of the casing and causing a permanent specific fuel consumption penalty for the engine.

To that end, proposed is a method for detecting an increase in the rotor speed of a low-pressure turbine of an aircraft reactor during a cruising flight phase, comprising measuring the rotor speed of the low-pressure turbine via a sensor.

According to one general feature of the invention, the method comprises determining a rotor speed gradient of the low-pressure turbine from the measured rotor speed, comparing said determined rotor speed gradient to a reference rotor speed gradient, determining a positive or negative indication that the aircraft is under cruising phase conditions from flight parameters of the aircraft, and activating an alarm if the determined rotor speed gradient is higher than the reference rotor speed gradient and if said received indication is positive.

The detection of the periods during a flight that have risks of deterioration of the elements of the aircraft, and in particular the detection during the cruising phase of a sudden increase in the rotation rate of the low-pressure turbine, makes it possible to emit an alarm signal that may cause the command of a plurality of operations, in particular a rapid decrease in the cooling air flow rate to be applied to the casing of the low-pressure turbine to allow the casing to expand quickly and sufficiently to maintain non-zero play with the apex of the vanes and prevent wear of the abradable coating.

This expansion thus makes it possible to maintain the integrity of the elements of the low-pressure turbine and thereby avoid deterioration of the performance of the aircraft, and consequently greater fuel consumption than the consumption provided for a given movement speed of the aircraft.

The determination of a positive or negative indication that the aircraft is under cruising phase conditions makes it possible to prevent an alarm from being activated during a phase other than the cruising phase, for example the takeoff phase. It is in fact common to observe high rotor speed gradient values of the low-pressure turbine during the takeoff phase without needing an alarm to be emitted or a cooling air flow rate to be modified, particularly if a specific cooling air flow rate is already provided.

Determination of a rotor speed gradient of the low-pressure turbine from the measured rotor speed refers to a calculation making it possible to determine the variation of the rotor speed of the low-pressure turbine over time. The determination of the gradient may for example comprise a calculation of the ratio between the variation of the rotor speed of the low-pressure turbine between the last rotor speed measurement and the preceding rotor speed measurement and the time elapsed between the two rotor speed measurements.

According to a first aspect of the method for detecting an increase in the rotor speed of a low-pressure turbine of an aircraft reactor during a cruising phase, the determination of the positive or negative indication that the aircraft is under cruising phase conditions may include a measurement of the movement speed of the aircraft, a comparison of the measured speed with a reference speed, and a comparison of said measured rotor speed with a movement reference rotor speed of the aircraft, said indication that the aircraft is under cruising phase conditions being positive if the measured speed is above said reference speed and if the rotor speed of the low-pressure turbine is greater than the reference rotor speed.

The cruising phase is the phase during which the low-pressure turbine and the movement speed of the aircraft are highest. Comparing these two parameters with corresponding reference thresholds makes it possible to ensure that the aircraft is in a cruising phase.

Taking account of these parameters to determine whether the aircraft is in a cruising phase makes it possible to use data already available and used in the system for regulating the cooling air flow rate of the low-pressure turbine LPTACC.

According to a second aspect of the method for detecting an increase in the rotor speed of a low-pressure turbine of an aircraft reactor during a cruising phase, the determination of the positive or negative indication that the aircraft is under cruising phase conditions may include receiving the value of the rotor speed requested by the user and comparing said value of the requested rotor speed to a requested reference speed, said indication that the aircraft is under cruising phase conditions being positive if the value of the requested rotor speed is greater than the requested reference rotor speed.

Taking account of the parameter relative to the rotor speed requested by the user, i.e., the command from the pilot to increase the rotor speed of the low-pressure turbine of the turbojet engine, makes it possible to use the parameter directly at the source of any increase in rotor speed.

According to a second aspect of the method for detecting an increase in the rotor speed of a low-pressure turbine of an aircraft reactor during a cruising phase, the value of the requested rotor speed may be determined from the value of the angular position of the thrust control lever.

The angular position of the thrust control lever is one of the parameters used in systems for regulating the cooling air flow rate of the low-pressure turbine LPTACC. The use of this parameter makes it possible not to modify the existing logic structure of systems for regulating the cooling air flow rate.

The present invention also relates to a method for regulating the cooling air flow rate applied on the surface of the casing of a low-pressure turbine of aircraft, characterized in that it comprises detecting an increase in the rotor speed of the low-pressure turbine of a reactor of an aircraft during a cruising phase as defined above, and reducing said cooling air flow rate applied following the detection of an increase in the rotor speed of said turbine.

Taking account of a logic for detecting a sudden increase phase of the rotor speed of the low-pressure turbine of a turbojet engine of an aircraft during a cruising phase makes it possible to give the regulating method the guarantee of applying a cooling air flow rate to the casing of the low-pressure turbine that is as suited as possible to the situation without using additional sensors, and more particularly, to minimize the cooling air flow rate sent onto the casing of the low-pressure turbine to allow the latter to expand and thereby prevent the abradable coating covering the inner surface from being damaged by the apex of the vanes of the low-pressure turbine. This thereby makes it possible to maintain the performance of the turbojet engine.

According to one aspect of the method for regulating the cooling air flow rate applied on the surface of the casing of a low-pressure turbine of an aircraft, reducing the cooling air flow rate comprises emitting a minimal opening signal of a cooling air valve to command the closing of said valve to a minimal opening of the valve.

The closing of the cooling valve of the casing of the low-pressure turbine to its minimal opening, or even until it is completely closed if possible and provided for, makes it possible to place the casing under temperature conditions identical to those of the vanes, and thus to generate a deformation as quickly as possible. This makes it possible to reduce the risk of rubbing of the vanes of the low-pressure turbine on the abradable coating.

The present invention also relates to an electronic control device for a cooling air valve of a low-pressure turbine of an aircraft comprising a module for controlling the cooling air flow rate able to reduce the air flow rate upon receiving an alarm indicating the detection of an increase of the rotor speed of the low-pressure turbine of the aircraft during a cruising phase.

According to one general feature of the invention, the device comprises a first sensor able to measure the rotor speed of the low-pressure turbine and a unit for detecting an increase in the rotor speed of a low-pressure turbine of an aircraft reactor during a cruising phase including a module for receiving the value of the rotor speed measured by the first sensor, a processing module able to compute a rotor speed gradient of the low-pressure turbine from the measured rotor speed, a first comparison module able to compare the determined rotor speed gradient to a reference rotor speed gradient, a module for determining a positive or negative indication that the aircraft is under cruising phase conditions from flight parameters of the aircraft, and an alarm module able to activate an alarm if the determined rotor speed gradient is greater than the reference rotor speed gradient and if said received indication is positive.

According to a first aspect of the electronic control device for a cooling air valve of a low-pressure turbine of an aircraft, the latter may comprise a second sensor able to measure the movement speed of the aircraft, the determining module further including a second comparison module able to compare the measured speed to a movement speed of the reference aircraft and a third comparison module able to compare the measured rotor speed to a reference rotor speed, the determining module being configured to generate a positive indication if the measured speed is greater than said reference speed and the rotor speed of the low-pressure turbine is greater than the reference rotor speed.

According to a second aspect of the electronic control device for a cooling air valve of a low-pressure turbine of an aircraft, the determining module may include a module for receiving the value of the rotor speed requested by the user, a fourth comparison module able to compare said value of the requested rotor speed to a reference requested rotor speed, said determining module being configured to generate a positive indication if the value of the requested rotor speed is greater than the reference requested rotor speed.

According to a third aspect of the electronic control device for a cooling air valve of a low-pressure turbine of an aircraft, the latter may further comprise a means for determining the requested rotor speed able to determine the value of the rotor speed requested by the user from the value of the angular position of the thrust control lever and sending said requested rotor speed value to said module for receiving the value of the rotor speed requested by the user.

The present invention also relates to an aircraft comprising an electronic control device for a cooling air valve of a low-pressure turbine of an aircraft as defined above.

BRIEF DESCRIPTION OF THE FIGURES

The invention will be better understood upon reading the following exemplary and non-limiting embodiment in reference to the appended drawings, in which.

DETAILED DESCRIPTION OF THE INVENTION

Figure 1:
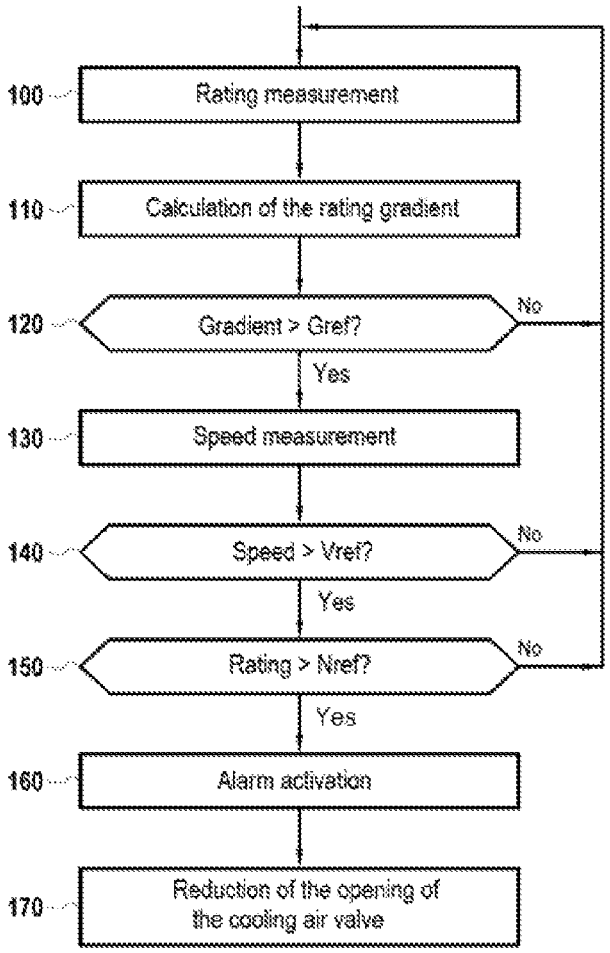
FIG. 1 is a flowchart of a method for regulating the cooling air flow rate applied on the surface of the casing of a low-pressure turbine of a turbojet engine of an aircraft according to the invention.

FIG. 1 shows a flowchart of a method for regulating the cooling air flow rate applied on the surface of the casing of a low-pressure turbine of a turbojet engine of an aircraft according to the invention, the regulating method comprising a method for detecting an increase in the rotor speed of a low-pressure turbine of a reactor during a cruising phase of an aircraft according to the invention.

In a first step 100, a measurement is done of the rotor speed of the low-pressure turbine of the turbojet engine in order to determine a gradient of the rotor speed. The objective being to determine, in a second step 110, a gradient G of the rotor speed of the turbine, the measurement done in the first step 100 may comprise a series of at least two measurements, two successive measurements being separated by a given time interval. The rotor speed measurements are done using a sensor mounted on the low-pressure turbine.

In the second step 110, the gradient G of the rotor speed of the low-pressure turbine of the turbojet engine is calculated. The calculation comprises determining a rotor speed variation from two rotor speed measurements of the low-pressure turbine, determining the time interval between the two measurements, then calculating the ratio between the rotor speed variation and the time interval over which the rotor speed variation took place.

In a third step 120, the value of the turbine rotor speed gradient G calculated in the preceding step 110 is compared to a reference rotor speed gradient Gref corresponding to a threshold from which the increase in the rotor speed of the turbine is great enough in a given time interval to be considered significant.

If the value of the turbine rotor speed gradient G is lower than the reference rotor speed gradient Gref, the rotor speed variation is not considered significant over the time interval in question and one returns to the first step 100.

Conversely, if the value of the turbine rotor speed gradient G is higher than the reference rotor speed gradient Gref, the rotor speed variation is considered to correspond to a potential rotor speed increase event during the cruising phase.

In this casing, in a step 130, the movement speed V of the aircraft is measured using a speed sensor, then a following step 140, the value of the measured movement speed V measurement is compared to a reference speed Vref corresponding to a speed threshold above which the aircraft is considered to be in the cruising phase, an aircraft generally reaching its maximum flight speed during the cruising phase.

If the measured speed value V is below the reference speed Vref, the aircraft is considered not to be in a cruising phase and one returns to the first step 100 of the method.

Conversely, if the value of the measured movement speed V of the aircraft is above the reference speed Vref, to verify that the aircraft is indeed in a cruising phase, in a following step 150, the value of the rotor speed $N_1$ measured by the rotor speed sensor of the low-pressure turbine is compared to a reference rotor speed Nref of the low-pressure turbine.

If the value of the measured rotor speed $N_1$ of the low-pressure turbine is below the reference rotor speed Nref, the aircraft is considered not to be in a cruising phase and one returns to the first step 100 of the method.

Conversely, if the value of the measured rotor speed $N_1$ of the low-pressure turbine is above the reference rotor speed Nref, the aircraft is considered to be in a cruising phase.

If the aircraft is determined to be a cruising phase in step 150, an alarm is activated in a following step 160.

The activation of the alarm then causes, in a step 170, a closing of the cooling air valve of the low-pressure turbine until it is minimally open so as to allow the casing to deform by thermal deformation and thus prevent the apex of the vanes of the rotor of the low-pressure turbine, which deform due to the increased rotor speed, from touching and wearing down the abradable coating present on the inner surface of the casing.

Figure 2:
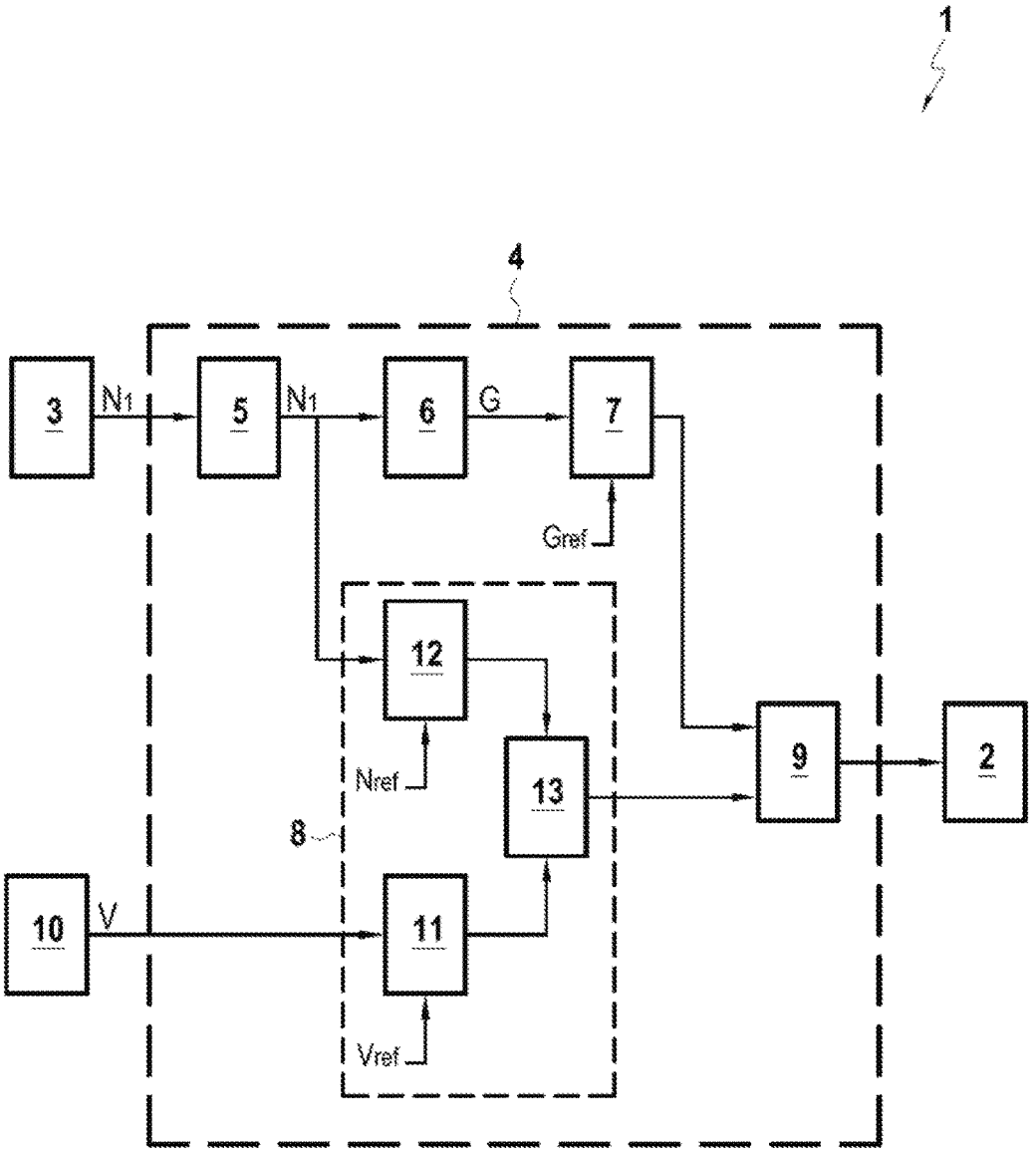
FIG. 2 diagrammatically shows an electronic control device for a cooling air valve of a low-pressure turbine of a turbojet engine of an aircraft according to the invention.

FIG. 2 diagrammatically shows an electronic control device 1 for a cooling air valve of a low-pressure turbine of a turbojet engine of an aircraft according to the invention.

The device 1 comprises a cooling air flow control module 2 applied on the casing of the low-pressure turbine configured to reduce the cooling air flow rate upon receiving an alarm indicating the detection of an increase in the rotor speed of the low-pressure turbine of the aircraft during a cruising phase.

The device 1 further comprises a rotor speed sensor 3 able to measure the rotor speed $N_1$ of the low-pressure turbine and a detection unit 4 detecting an increase in the rotor speed of the low-pressure turbine of at least one turbojet engine of the aircraft during a cruising phase.

The detection unit 4 includes a receiving module 5 coupled to the output of the rotor speed sensor 3 and configured to receive the value of the rotor speed $N_1$ measured by the rotor speed sensor 3.

The detection unit 4 further includes a processing module 6 coupled to the output of the receiving module 5 that delivers the value of the measured rotor speed $N_1$ of the low-pressure turbine and a first comparison module 7 coupled to the output of the processing module 6. The processing unit 6 is configured to compute a rotor speed gradient G of the low-pressure turbine from the value of the measured rotor speed $N_1$ and the first comparison module 7 is configured to compare the determined rotor speed gradient G to a reference rotor speed gradient Gref.

The detection unit 4 further comprises a module 8 for determining a positive or negative indication that the aircraft is under cruising phase conditions from flight parameters of the aircraft, and an alarm module 9 configured to activate an alarm if the determined low-pressure turbine rotor speed gradient G is higher than the reference rotor speed gradient Gref and if said received indication determined by the determining module 8 is positive.

The device 1 comprises a speed sensor 10 able to measure the movement speed of the aircraft. The determining module 8 includes a second comparison module 11 coupled to the output of the speed sensor 10 and configured to compare the speed V measured by the speed sensor 10 to a reference movement speed Vref of the aircraft.

The determining module 8 comprises a third comparison module 12 coupled to the output of the receiving means 5 and configured to compare the measured value of the rotor speed $N_1$ to a reference rotor speed Nref.

To determine whether the aircraft is indeed in a cruising phase, the determining module 8 includes a control unit 13 coupled to the output of the second comparator 11 and the third comparator 12 and configured to generate a positive indication signal if the measured speed V is greater than said reference speed Vref and if the rotor speed of the low-pressure turbine $N_1$ is greater than the reference rotor speed Nref.

The alarm module 9 of the detection unit 4 is coupled to the output of the first comparator 7 and the output of the control unit 13 of the determining module 8. The alarm module 9 is configured to deliver an alarm signal based on signals received from the first comparator 7 and the control unit 13, and more specifically if the determined low-pressure turbine rotor speed gradient G is greater than the reference rotor speed gradient Gref and if the indication determined by the determining module 8 and delivered by the control unit 13 is positive.

The alarm module 9 delivers the alarm signal to the cooling air flow rate control module 2 applied on the casing of the low-pressure turbine.

The invention thus makes it possible to anticipate the sudden elongation of the vanes of the low-pressure turbine that may occur during rotor speed increase phases of the low-pressure turbine even within a cruising phase. The anticipation allowed by the detection of the sudden rotor speed increase phase of the low-pressure turbine thus makes it possible to greatly decrease or even eliminate the risk of wearing of the abradable coating of the casing during rotor speed increase phases during a cruising phase, and thus to limit the risks of harming the performance of the aircraft, and in particular permanently increasing the fuel consumption for the engine.

The invention claimed is:

1. A method for detecting an increase in a rotor speed of a low-pressure turbine of an aircraft reactor during a cruising phase, the method comprising:

measuring a first rotor speed of the low-pressure turbine at a first time via a sensor;

measuring a second rotor speed of the low-pressure turbine at a second time subsequent to the first time via the sensor;

determining a rotor speed gradient of the low-pressure turbine as the ratio between the difference between the first rotor speed and the second rotor speed, and the time interval between the first time and second time;

comparing said determined rotor speed gradient to a reference rotor speed gradient;

determining a positive or negative indication that the aircraft is under cruising phase conditions from flight parameters of the aircraft;

activating an alarm when the determined rotor speed gradient is higher than the reference rotor speed gradient and when said received indication is positive;

and reducing a cooling air flow rate applied to the low-pressure turbine when the determined rotor speed gradient is higher than the reference rotor speed gradient and when said received indication is positive;

wherein reducing the cooling air flow rate comprises emitting a minimal opening signal of a cooling air valve to command the closing of said valve to a minimal opening of the valve.

2. The method according to claim 1, wherein the determination of the positive or negative indication that the aircraft is under cruising phase conditions may include a measurement of the movement speed of the aircraft, a comparison of the measured speed with a reference movement speed of the aircraft, and a comparison of said measured first rotor speed with a movement reference speed of the aircraft, said indication that the aircraft is under cruising phase conditions being positive when the measured speed is above said reference speed and when the first rotor speed of the low-pressure turbine is greater than the reference speed.

3. The method according to claim 1, wherein the determination of the positive or negative indication that the aircraft is under cruising phase conditions includes receiving the value of a rotor speed requested by the user and comparing said value of the requested rotor speed to a requested reference rotor speed, said indication that the aircraft is under cruising phase conditions being positive when the value of the requested rotor speed is greater than the requested reference rotor speed.

4. The method according to claim 3, wherein the value of the requested rotor speed is determined from a value of an angular position of a thrust control lever.

* * * * *